US009418611B2

(12) United States Patent
Tuikkanen et al.

(10) Patent No.: US 9,418,611 B2
(45) Date of Patent: Aug. 16, 2016

(54) LED BACKLIGHT CONTROLLER

(75) Inventors: Tuomas Tapani Tuikkanen, Oulu (FI); Jeremy K. Yaeger, Santa Clara, CA (US); Mikko Topi Loikkanen, Oulu (FI); Tomi Juhani Koskela, Sunnyvale, CA (US)

(73) Assignee: NATIONAL SEMICONDUCTOR CORPORATION, Santa Clara, CA (US)

( * ) Notice: Subject to any disclaimer, the term of this patent is extended or adjusted under 35 U.S.C. 154(b) by 315 days.

(21) Appl. No.: 13/154,298

(22) Filed: Jun. 6, 2011

(65) Prior Publication Data

US 2012/0182209 A1 Jul. 19, 2012

Related U.S. Application Data

(60) Provisional application No. 61/433,465, filed on Jan. 17, 2011.

(51) Int. Cl.
*G09G 3/34* (2006.01)
*G09G 3/36* (2006.01)

(52) U.S. Cl.
CPC ..... *G09G 3/3648* (2013.01); *G09G 3/342* (2013.01); *G09G 2310/024* (2013.01); *G09G 2310/08* (2013.01); *G09G 2320/0233* (2013.01); *G09G 2320/064* (2013.01); *G09G 2330/06* (2013.01)

(58) Field of Classification Search
CPC ..... G09G 3/342
USPC ..... 345/102; 349/61–70; 362/561
See application file for complete search history.

(56) References Cited

U.S. PATENT DOCUMENTS

2009/0213063 A1* 8/2009 Shimura ..... 345/102
2009/0237415 A1 9/2009 Athas
2010/0020004 A1 1/2010 Smith
2010/0091048 A1 4/2010 Aitken et al.

OTHER PUBLICATIONS

U.S. Appl. No. 12/925,030, filed Oct. 12, 2010 to Väänänen et al.

* cited by examiner

*Primary Examiner* — Alexander Eisen
*Assistant Examiner* — Cory Almeida
(74) *Attorney, Agent, or Firm* — Andy Viger; Frank D. Cimino

(57) ABSTRACT

The line banding image artifact that results from the interaction of LCD ripple and LED flicker in an LCD device that utilizes LED backlighting strings is substantially reduced by selecting a number of LED strings, individually driving the number of LED strings with a corresponding number of identical clock signals that are equally phase delayed, and selecting the frequency of the clock signals so that the product of the frequency of the clock signal multiplied by the number of LED strings is equal to the line clock frequency.

12 Claims, 4 Drawing Sheets

LED BACKLIGHT CONTROLLER

This application claims benefit from Provisional Application No. 61/433,465 filed on Jan. 17, 2011 for Tuomas Tapani Tuikkanen et al.

BACKGROUND OF THE INVENTION

1. Field of the Invention

The present invention relates to LED backlights and, more particularly, to an LED backlight controller.

2. Description of the Related Art

A liquid crystal display (LCD) panel is a type of display panel commonly used in electronic devices, such as lap top computers, cell phones, and televisions. The image displayed on an LCD panel is comprised of an array of dots or picture elements (pixels). In a conventional color image, each dot or pixel includes a number of colored dots or sub-pixels, such as a red dot or sub-pixel, a green dot or sub-pixel, and a blue dot or sub-pixel.

LCD panels include a light source, a pair of polarizers, and an array of liquid crystal regions. Color LCD panels have a liquid crystal region with a color filter for each colored dot or sub-pixel, and a number of liquid crystal regions (e.g., one with a red filter, one with a green filter, and one with a blue filter) for each dot or pixel.

In operation, light from the light source passes through a first polarizer of the pair of polarizers, and then into the array of liquid crystal regions. The liquid crystal regions are individually controlled by thin-film transistors that vary the voltages across the liquid crystal regions which, in turn, varies the amount of light from the light source that can pass through the liquid crystal regions.

For example, when a first voltage lies across a liquid crystal region, the liquid crystal region rotates the polarization of the light, which then passes out of a second polarizer of the pair of polarizers with a maximum light intensity. On the other hand, when a second voltage lies across the liquid crystal region, the liquid crystal region rotates the polarization of the light so that substantially none of the light passes out of the second polarizer. Voltages that lie between the first and second voltages, in turn, allow varying amounts of light to pass out of the second polarizer.

Thus, when a liquid crystal region is covered with a red filter, which represents a red dot or sub-pixel, red light with a maximum intensity passes out of the second polarizer when the first voltage lies across the liquid crystal region, no light passes out of the second polarizer when the second voltage lies across the liquid crystal region, and one of a number of shades of red passes out of the second polarizer when one of a number of voltages between the first and second voltages lies across the liquid crystal region. For example, 256 shades of red require 256 voltage steps between the first voltage (maximum intensity) and the second voltage (no light) which, in turn, can be represented with an eight-bit word.

FIG. 1 shows a block diagram that illustrates an example of a conventional LCD device 100. As shown in FIG. 1, LCD device 100 includes an LCD panel 110 that has a number of liquid crystal regions 112 that are arranged in an array with m columns and n lines. Each line of liquid crystal regions 112 represents a number of pixels 114, while each pixel 114 includes a number of sub-pixels 116, such as a red sub-pixel 116R, a green sub-pixel 116G, and a blue sub-pixel 116B. For example, a conventional LCD panel with 1024 pixels per line and three sub-pixels per pixel has 3,072 (1024×3) liquid crystal regions 112 per line.

As further shown in FIG. 1, LCD device 100 also includes a source (or column) driver circuit 120 that is electrically connected to the thin-film transistors that are associated with the liquid crystal regions 112 within LCD panel 110. Source driver circuit 120 includes a number of latches 122 that are arranged in a row so that each column of liquid crystal regions 112 has a corresponding latch 122. The row of latches 122, in turn, is connected to receive a stream of image data DBS, a pixel clock signal PCLK, and an enable signal (not shown).

In operation, sub-pixel image data from the stream of image data DBS is sequentially loaded into the latches 122 on the rising edges of the pixel clock signal PCLK. For example, a first latch 122-1 can be enabled to latch a first eight-bit word (which identifies one of 256 voltage steps) from the stream of image data DBS on a first rising edge of the pixel clock signal PCLK, while a second latch 122-2 can be enabled to latch a second eight-bit word from the stream of image data DBS on a second rising edge of the pixel clock signal PCLK.

Further, a $3{,}072^{nd}$ latch 122-3072 can be enabled to latch a $3{,}072^{nd}$ eight-bit word from the stream of image data DBS on a $3{,}072^{nd}$ rising edge of the pixel clock signal PCLK. After sub-pixel image data has been loaded into each latch 122 in the row, the rising edge of a local line clock signal LLCLK (which coincides with the $3{,}073^{rd}$ rising edge of the pixel clock signal PCLK) causes the sub-pixel image data stored in the row of latches 122 to be latched and output by a row of secondary latches. A row of digital-to-analog (D/A) converter driver circuits then converts the sub-pixel image data output by the row of secondary latches to analog values, and drives out the analog values.

As additionally shown in FIG. 1, LCD device 100 also includes a gate (or row) driver circuit 130 that is electrically connected to the thin-film transistors that are associated with the liquid crystal regions 112 within LCD panel 110. Gate driver circuit 130 can be implemented with a shift register that has one output for each line of the array.

In operation, gate driver circuit 130 drives a gate voltage to sequential rows of the thin-film transistors that are associated with sequential rows of liquid crystal regions 112 in response to the rising edges of the local line clock signal LLCLK. For example, after the $3{,}072^{nd}$ rising edge of the pixel clock signal PCLK has loaded sub-pixel image data into latch 122-3072, a first rising edge of the local line clock signal LLCLK causes gate driver circuit 130 to drive the gate voltage to the thin-film transistors associated with the liquid crystal regions 122 in the first row.

At the same time, the first rising edge of the local line clock signal LLCLK also causes source driver circuit 120 to output analog voltages that correspond to the digital values stored in the row of secondary latches. Since the thin-film transistors associated with the liquid crystal regions 122 in the first row are the only transistors to receive the gate voltage, only the thin-film transistors associated with the liquid crystal regions 122 in the first row respond to the analog voltages output by source driver circuit 120.

During the next $3{,}072^{nd}$ rising edges of the pixel clock signal PCLK, the sub-pixel image data stored in the latches 122 are overwritten with new sub-pixel image data from the stream of image data DBS. After the next $3{,}072^{nd}$ rising edge of the pixel clock signal PCLK has loaded sub-pixel image data into latch 122-3072, a second rising edge of the local line clock signal LLCLK causes gate driver circuit 130 to drive the gate voltage to the thin-film transistors associated with the liquid crystal regions 122 in the second row.

At the same time, the second rising edge of the local line clock signal LLCLK also causes source driver circuit 120 to output analog voltages that correspond to the new digital values that are now stored in the row of secondary latches. Since the thin-film transistors associated with the liquid crystal regions 122 in the second row are the only transistors to receive the gate voltage, only the thin-film transistors associated with the liquid crystal regions 122 in the second row respond to the analog voltages output by source driver circuit 120.

As also shown in FIG. 1, LCD device 100 includes a timing controller 140 that receives the stream of image data DBS and a number of timing signals, including the pixel clock signal PCLK, a line clock signal LCLK, and a frame clock signal FCLK from a graphics processor unit (GPU) 142. In addition, timing controller 140 outputs the stream of image data DBS and a number of timing signals, including the pixel clock signal PCLK, the local line clock signal LLCLK, and a local frame clock signal FLCLK.

The frequency of the pixel clock signal PCLK is approximately equal to the number of pixels in a line multiplied by the number of lines in a frame multiplied by the frame rate. For example, an LCD display having an image size of 1280 pixels by 800 lines and a frame rate of 60 Hz has a pixel clock frequency of approximately 61.44 MHz (ignoring the blanking times to simplify the example).

In operation, timing controller 140 divides down the frequency of the pixel clock signal PCLK to generate the local line clock signal LLCLK and the local frame clock signal FLCLK. For example, timing controller 140 can divide down the 61.44 MHz pixel clock signal PCLK to generate a 48.00 KHz local line clock signal LLCLK and a 60 Hz local frame clock signal FLCLK.

Timing controller 140 generates the local frame clock signal FLCLK because the frame clock signal FCLK output by GPU 142 is subject to jitter relative to the pixel clock signal PCLK, thereby making the frame clock signal FCLK less accurate than the local frame clock signal FLCLK. The line clock signal LCLK, which is over two orders of magnitude greater than the frame clock signal FCLK, is sufficiently accurate to be used, thereby making the decision on whether to locally generate the line clock signal optional.

FIGS. 2A-2D show a series of timing diagrams that illustrate the operation of LED device 100. FIG. 2A shows the local line clock signal LLCLK. FIG. 2B shows a representative voltage V1 for a first row of sub-pixels. FIG. 2C shows a representative voltage V2 for a second row of sub-pixels. FIG. 2D shows a representative voltage V3 for a third row of sub-pixels.

During each pulse of the local line clock signal LCLK, the voltages across all of the liquid crystal regions in a row of liquid crystal regions are individually charged up. However, after being charged up, the voltages decay until charged up again. Thus, there is a jump in voltage that results from the increased charge, followed by a slow decay period.

As shown in FIGS. 2A-2D, the voltages across all of the liquid crystal regions in the first line of liquid crystal regions are individually charged up during period T1 of the local line clock signal LLCLK. In addition, the voltages across all of the liquid crystal regions in the second line of liquid crystal regions are individually charged up during period T2, and the voltages across all of the liquid crystal regions in the third line of liquid crystal regions are individually charged up during period T3.

As further shown in FIGS. 2A-2D, the progression from line to line of the jump in voltage (resulting from the increase in charge) causes an image defect known as LCD ripple. However, since the LCD ripple occurs at the local line clock frequency (one jump per local line clock period), the defect can not be seen by the human eye.

The source of light in an LCD panel is commonly provided by a number of lamps that are miniature versions of fluorescent tubes, but is increasingly being provided by strings of light emitting diodes (LED). For example, rather than using lamps, a number of strings of LEDs (e.g., two strings, three strings, or six strings) can alternately be used. LED strings have a number of advantages over conventional lamps, including lower power requirements and a longer service life.

In the FIG. 1 example, LCD device 100 also includes an LED backlight source 150 that includes three LED strings 152, and an LED backlight controller 154 that controls the operation of the LED strings 152. In the present example, LED backlight controller 154 includes a synchronizer 160 that synchronizes a control clock signal CCLK from a system host controller 156 and the frame clock signal FCLK from GPU 142 to generate a synchronized control clock signal SCLK.

LED backlight controller 154 also includes a pulse width modulator 162 that pulse width modulates the synchronized clock signal SCLK in response to a duty cycle bias voltage BS from system host controller 156 to generate a pulse width modulated control clock signal MCLK that drives the LED strings 152. The brightness of the light produced by the LED strings 152 is controlled by the duty cycle of the pulse width modulated control clock signal MCLK.

One of the problems with using LED strings in place of lamps as the source of light is that the frequency difference between the local line clock signal LLCLK and the modulated control clock signal MCLK causes visible line banding artifacts to appear having alternating groups of brighter and darker lines. In addition, if synchronizer 160 is omitted so that the modulated control clock signal MCLK is not synchronized to the frame clock signal FCLK (by way of the synchronized clock signal SCLK), then the line banding artifacts scroll up or down.

FIG. 3 shows a timing diagram of the modulated control clock signal MCLK that illustrates the formation of line banding artifacts. As shown in FIG. 3, the modulated control clock control signal MCLK is conventionally much slower than the line clock signal LCLK, typically having a frequency of approximately 1 KHz as compared to the 48 KHz line clock signal LCLK.

As further shown in FIG. 3, if the modulated control clock signal MCLK is used to simultaneously drive the three LED strings 152, then the LED strings turn on and turn off, thereby generating an image defect known as LED flicker. LED flicker occurs at the frequency of the control clock signal CCLK (the LED strings are on and off once per control clock period), and as a result can not be seen by the human eye. However, as additionally shown in FIG. 3, the interaction between the LCD ripple and the LED flicker produces banding artifacts that generate bands of brighter lines and bands of darker lines that are visible to the human eye.

One approach to reducing the line banding artifacts is to modify LED backlight controller 154 to drive the LED strings 152 individually with the modulated control clock signal MCLK and a number of phase delayed versions of the modulated control clock signal MCLK. For example, the modulated control clock signal MCLK and two delayed versions of the modulated clock signal MCLK, each delayed 120° from the previous control signal, can be utilized with three LED strings 152.

In the FIG. 1 example, the pulse width modulator 162 of LED backlight controller 154 includes delay circuitry that generates a delayed modulated control clock signal DCLK1 which is delayed 120° from the modulated control clock signal MCLK, and a delayed modulated control clock signal DCLK2 which is delayed 120° from the delayed modulated control clock signal DCLK1.

FIGS. 4A-4C show a series of timing diagrams that illustrate the operation of LED device 100 with phase delayed LED strings. FIG. 4A shows a delayed modulated control clock signal DCLK1 which is delayed 120° from the modulated control clock signal MCLK, while FIG. 4B shows a delayed modulated control clock signal DCLK2 which is delayed 120° from the delayed modulated control clock signal DCLK1. FIG. 4C shows a composite total LED on time.

As shown in FIGS. 3 and 4A-4C, while the line banding artifacts have not been eliminated, the intensity of the banding artifacts has been substantially reduced by individually driving the LED strings 152 with the modulated control clock signal MCLK and the delayed modulated control clock signals DCLK1 and DCLK2. However, the improvement shown in FIG. 4C, which is based on a 50% duty cycle, fades as the duty cycle of the modulated clock signal MCLK is changed.

Many LCD devices sense the ambient light, and adjust the duty cycle of the modulated control clock signal MCLK to adjust the brightness of the light produced by the LED strings in response to the intensity of the ambient light. The change in duty cycle then significantly worsens the line banding artifacts. Thus, there is a need for an LCD device that reduces line banding artifacts when the duty cycle of the modulated clock signal MCLK is varied.

BRIEF DESCRIPTION OF THE DRAWINGS

FIG. 2A illustrates the local line clock signal LLCLK. FIG. 2B illustrates a representative voltage V1 for a first row of sub-pixels. FIG. 2C illustrates a representative voltage V2 for a second row of sub-pixels. FIG. 2D illustrates a representative voltage V3 for a third row of sub-pixels.

FIG. 4A illustrates a delayed modulated control clock signal DCLK1 which is delayed 120° from the modulated control clock signal MCLK. FIG. 4B illustrates a delayed modulated control clock signal DCLK2 which is delayed 120° from the delayed modulated control clock signal DCLK1. FIG. 4C illustrates a composite total LED on time.

FIG. 6A illustrates the line clock signal LCLK.

FIG. 6N illustrates a composite total LED on time.

DETAILED DESCRIPTION OF THE INVENTION

Figure 1:
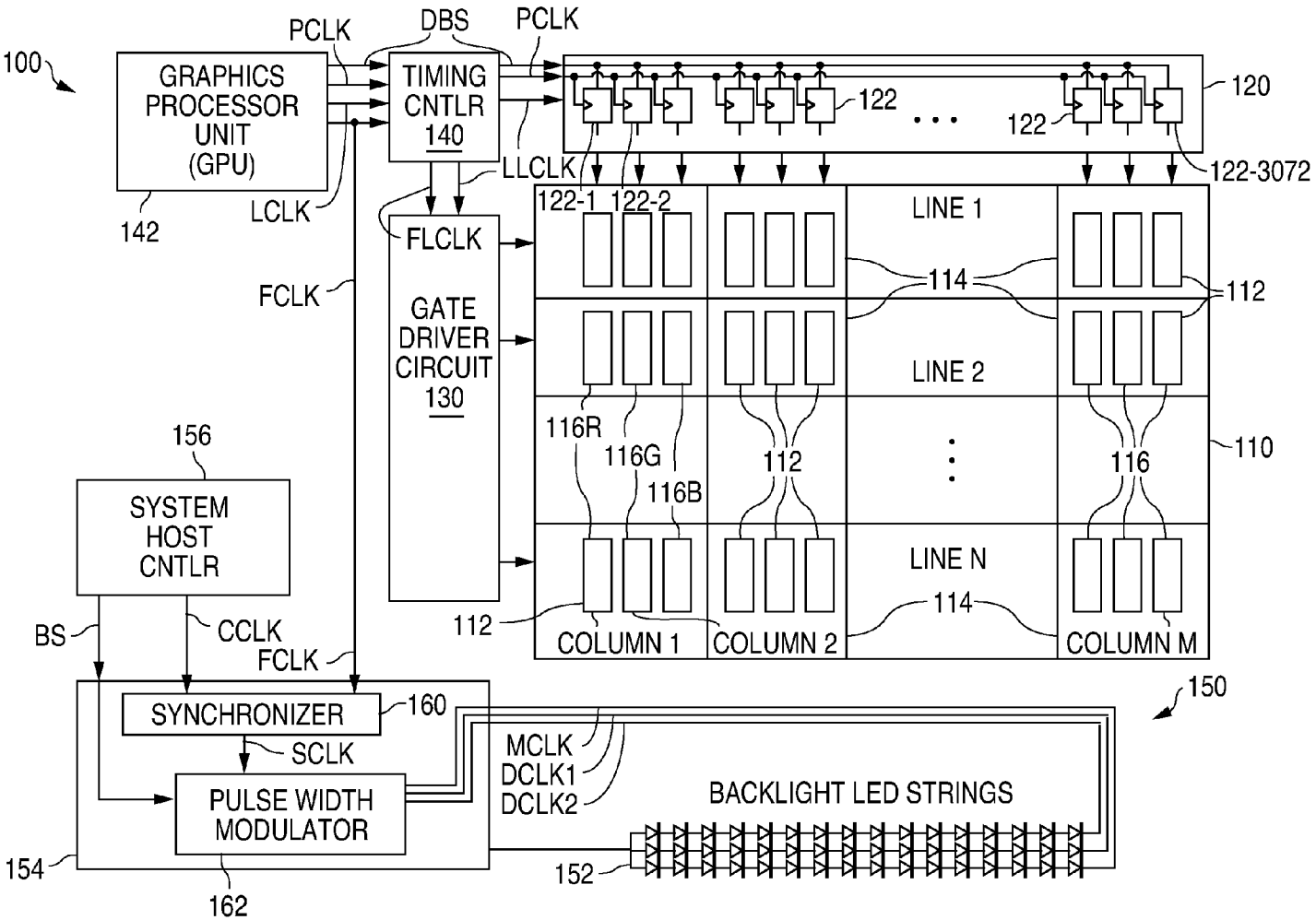
FIG. 1 (PRIOR ART)
FIG. 1 is a block diagram illustrating an example of a conventional LCD device 100.
Figures 2A, 2B, 2C, 2D, 3, 4A, 4B, 4C:
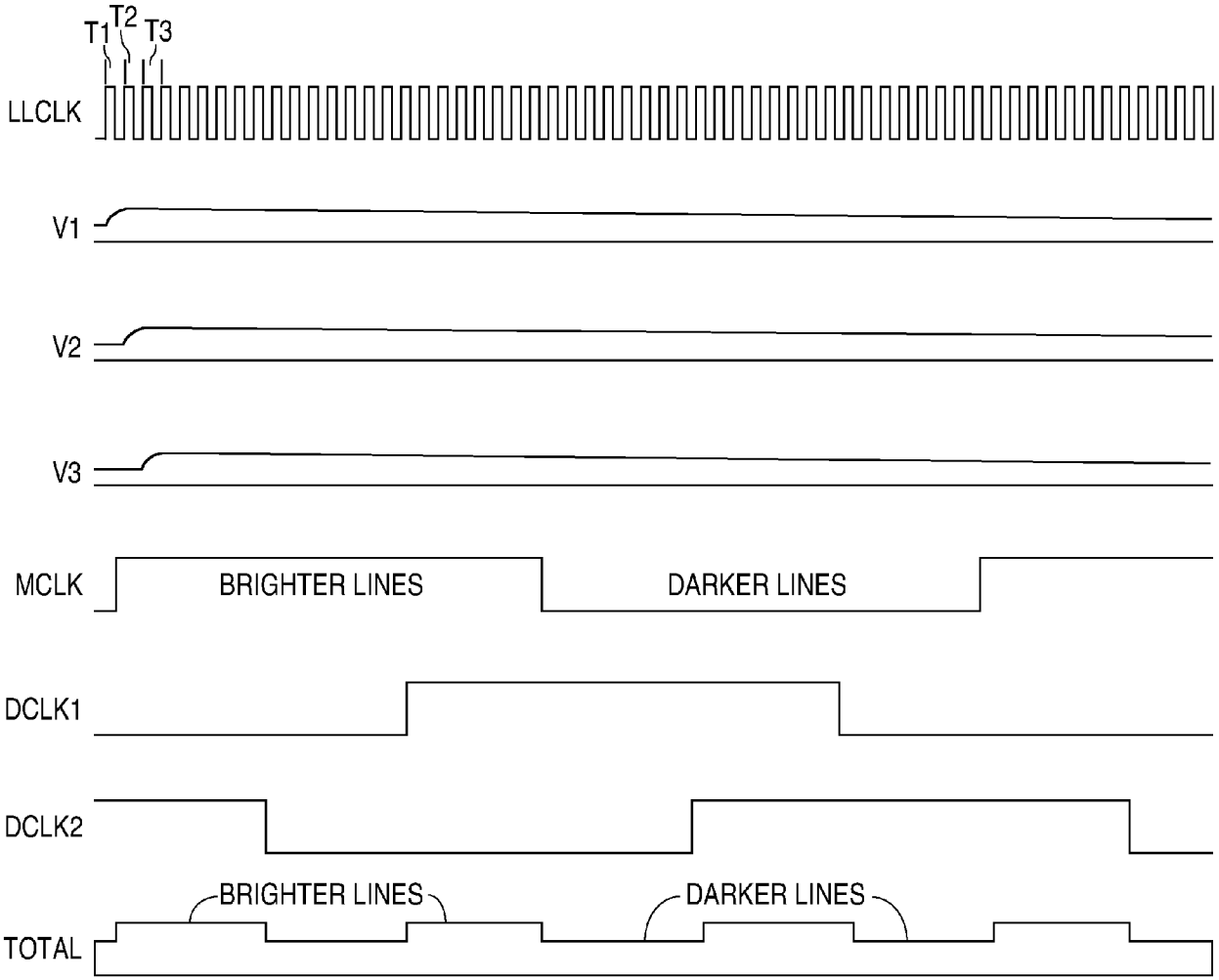
FIG. 2A (PRIOR ART)
FIG. 2B (PRIOR ART)
FIG. 2C (PRIOR ART)
FIG. 2D (PRIOR ART)
FIG. 3 (PRIOR ART)
FIG. 4A (PRIOR ART)
FIG. 4B (PRIOR ART)
FIG. 4C (PRIOR ART)
FIGS. 2A-2D are a series of timing diagrams illustrating the operation of LED device 100.
FIG. 3 is a timing diagram of the modulated control clock signal MCLK illustrating the formation of line banding artifacts.
FIGS. 4A-4C are a series of timing diagrams illustrating the operation of LED device 100 with phase delayed LED strings.
Figure 5:
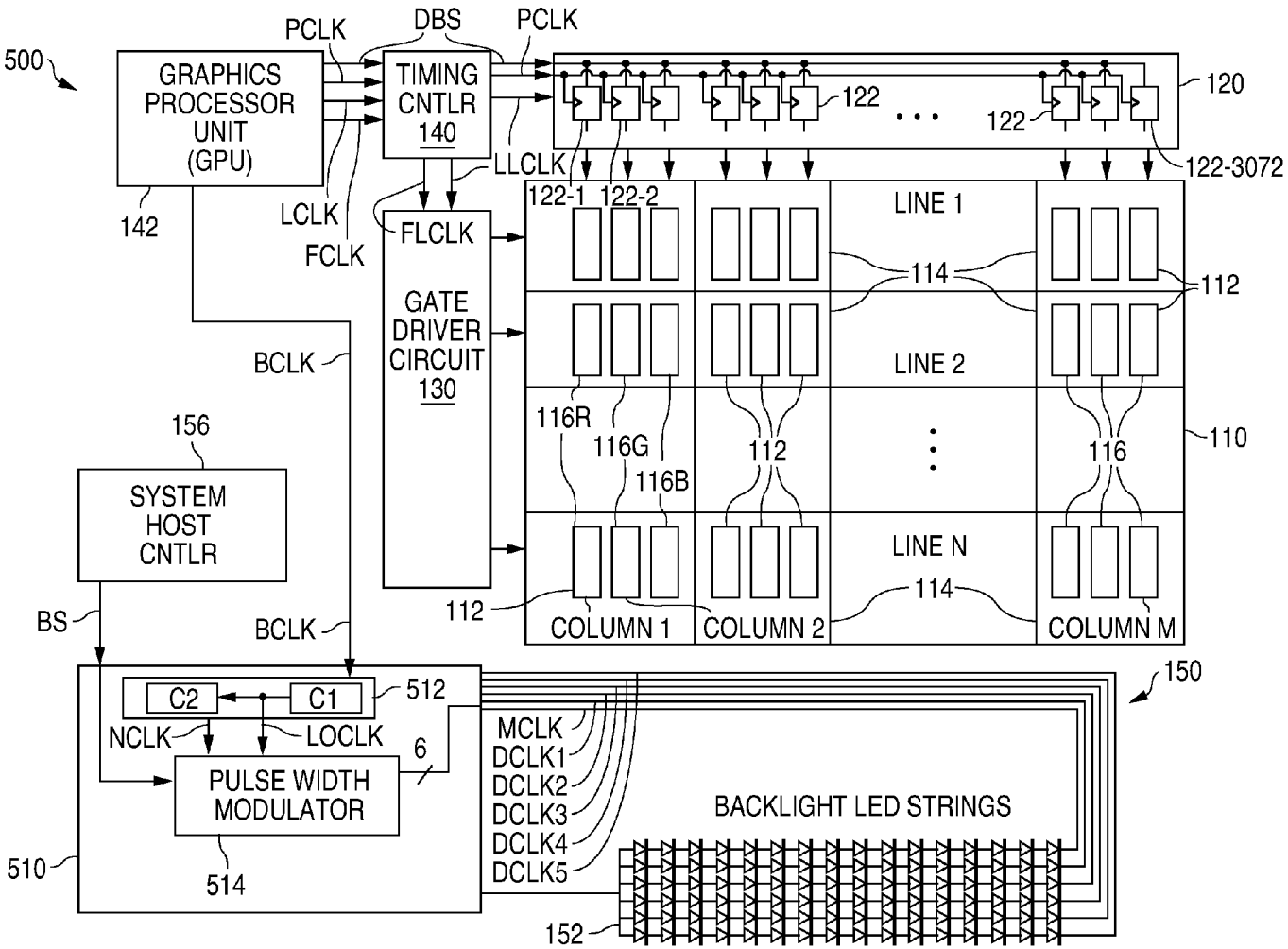
FIG. 5 is a block diagram illustrating an example of an LCD device 500 in accordance with the present invention.

FIG. 5 shows a block diagram that illustrates an example of an LCD device 500 in accordance with the present invention. LCD device 500 is similar to LCD device 100 and, as a result, utilizes the same reference numerals to designate the structures which are common to both LCD devices.

As shown in FIG. 5, LCD device 500 differs from LCD device 100 in that LCD device 500 can utilize a different number of LED strings 152. In addition, LED device 500 utilizes an LED backlight controller 510 in lieu of LED backlight controller 154. Further, LCD device 500 also routes a backlight clock signal BCLK to LED backlight controller 510 in lieu of the frame clock signal FCLK, and eliminates the control clock signal CCLK.

In accordance with the present invention, the frequency of the modulated control clock signal MCLK and the number of LED strings 152 are selected so that the product of the frequency of the modulated control clock signal MCLK multiplied by the number of LED strings 152 is equal to the line clock frequency LCLK.

The line clock frequency LCLK is equal to the product of the frame rate multiplied by the number of lines. For example, an LCD display having an image size of 1280 pixels by 800 lines and a frame rate of 60 Hz has a line clock frequency of 48.00 KHz (60*800). Thus, eight LED strings 152 require a modulated control clock frequency of 6 KHz, while six LED strings 152 require a modulated control clock frequency of 8 KHz and four LED strings 152 require a modulated control clock frequency of 12 KHz. In the present example, LED device 500 utilizes six LED strings 152.

As further shown in FIG. 5, LED backlight controller 510 includes a clock divider 512 that divides down the frequency of the backlight clock signal BCLK to form an intermediate clock signal NCLK. The frequency of the intermediate clock signal NCLK determines the frequency of the modulated clock signal MCLK.

For example, as additionally shown in FIG. 5, a 160-count counter C1 can be used to divide down a 7.68 MHz backlight clock signal BCLK to form a 48 KHz local line clock signal LOCLK, which is then divided down by a 6-count counter C2 to form an 8 KHz intermediate clock signal NCLK. In this case, the local line clock signal LOCLK and the line clock signal LCLK are substantially identical and in phase. Alternately, a 960-count counter can be used to divide down a 7.68 MHz backlight clock signal BCLK to form an 8 KHz intermediate clock signal NCLK.

LED backlight controller 510 also includes a pulse width modulator 514 that pulse width modulates the intermediate clock signal NCLK in response to the duty cycle bias voltage BS that is received from system host controller 156 to generate a pulse width modulated control clock signal MCLK.

In addition, pulse width modulator 514 also includes delay circuitry that generates a number of delayed modulated control clock signals DCLK that are equal to one less than the number of LED strings 152. Since LED device 500 utilizes six LED strings 152 in the present example, pulse width modulator 514 generates delayed modulated control clock signals DCLK1, DCLK2, DCLK3, DCLK4, and DCLK5.

The backlight clock signal BCLK, in turn, is synchronized to the pixel clock signal PCLK, and has a frequency that lies in a range of frequencies. The range of frequencies is defined at an upper end by the frequency of the pixel clock signal PCLK and at the lower end by a divided down frequency. The divided down frequency, which is a critical point, is the lowest frequency which is sufficient to maintain a low jitter margin and thereby an accurate clock signal.

For example, a backlight clock signal BCLK that has a frequency which is approximately two orders of magnitude greater than the frequency of the frame clock signal FCLK, e.g., approximately greater than 6 KHz for a 60 Hz frame clock signal FCLK, can be the lowest frequency which is sufficient to maintain a low jitter margin and thereby an accurate clock signal.

Thus, in the present example, the range of frequencies extends from 61.44 MHz (the pixel clock frequency) to 6 KHz (two orders of magnitude greater than the frame clock signal of 60 Hz). Further, in the present example, GPU 142 divides down the frequency of the 61.44 MHz pixel clock signal PCLK by eight to output a 7.68 MHz backlight clock signal BCLK. A 7.68 MHz clock backlight clock signal BCLK remains highly synchronized to the pixel clock signal (little effect from jitter), but requires less power and generates less electromagnetic interference (EMI).

Figures 6A, 6B, 6C, 6D, 6E, 6F, 6G, 6H, 6I, 6J, 6K, 6L, 6M, 6N:
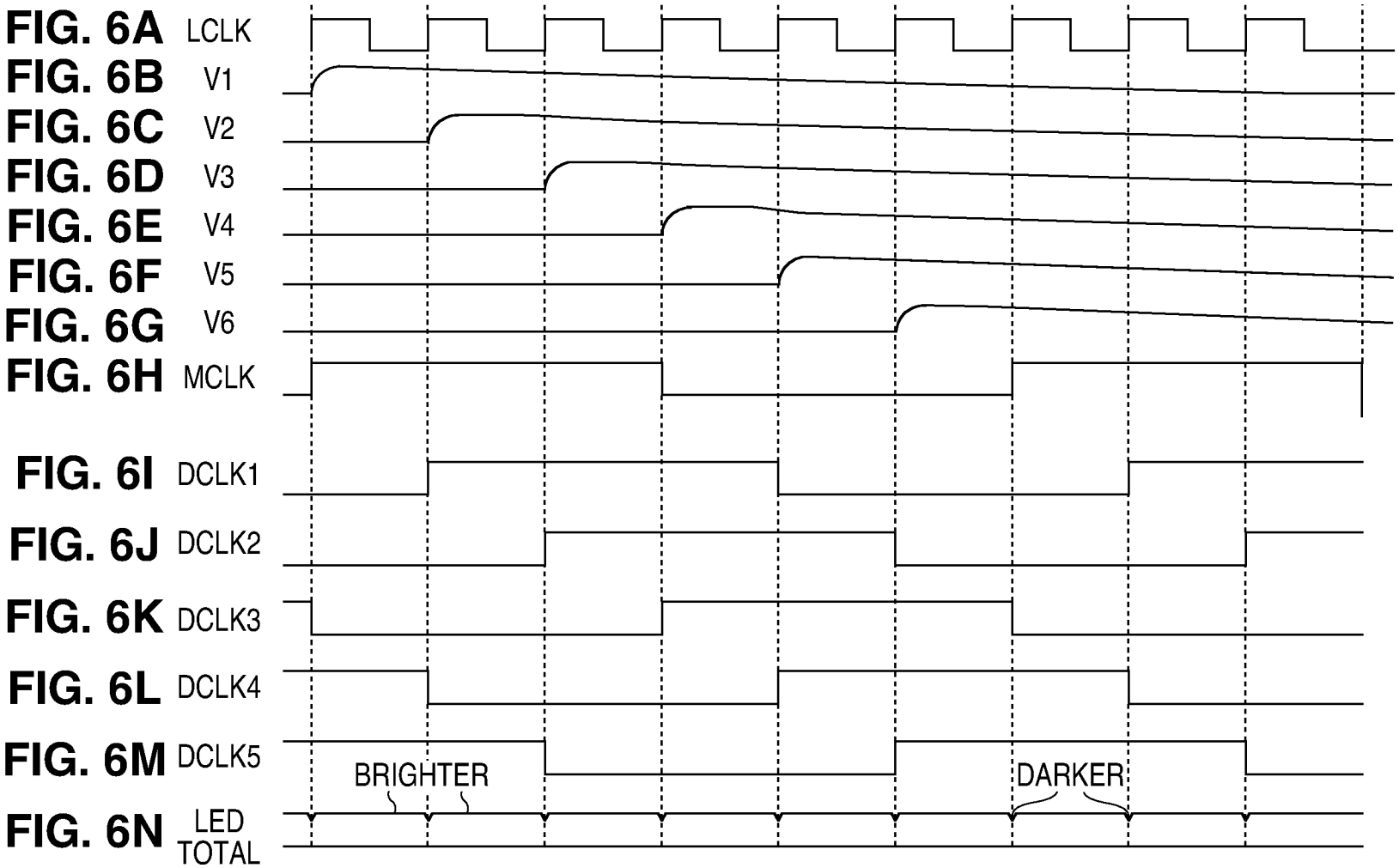
FIGS. 6A-6N are a series of timing diagrams illustrating the operation of LED device 500 in accordance with the present invention.
FIG. 6B illustrates a representative voltage V1 for a first row of sub-pixels.
FIG. 6C illustrates a representative voltage V2 for a second row of sub-pixels.
FIG. 6D illustrates a representative voltage V3 for a third row of sub-pixels.
FIG. 6E illustrates a representative voltage V4 for a fourth row of sub-pixels.
FIG. 6F illustrates a representative voltage V5 for a fifth row of sub-pixels.
FIG. 6G illustrates a representative voltage V6 for a sixth row of sub-pixels.
FIG. 6H illustrates the modulated control clock signal MCLK.
FIG. 6I illustrates a delayed modulated control clock signal DCLK1 that is delayed 60° from the modulated control clock signal MCLK.
FIG. 6J illustrates a delayed modulated control clock signal DCLK2 that is delayed 60° from the LED control signal DCLK1.
FIG. 6K illustrates a delayed modulated control clock signal DCLK3 that is delayed 60° from the delayed modulated control clock signal DCLK2.
FIG. 6L illustrates a delayed modulated control clock signal DCLK4 that is delayed 60° from the delayed modulated control clock signal DCLK3.
FIG. 6M illustrates a delayed modulated control clock signal DCLK5 that is delayed 60° from the delayed modulated control clock signal DCLK4.

FIGS. 6A-6N show a series of timing diagrams that illustrate the operation of LCD device 500 in accordance with the present invention. FIGS. 6A-6G show that the LCD ripple image defect that results from the progression from line to line of the jump in voltage (resulting from the increase in charge), which was present in LCD device 100, is also present in LCD device 500.

FIG. 6A shows the line clock signal LCLK. FIG. 6B shows a representative voltage V1 for a first row of sub-pixels. FIG. 6C shows a representative voltage V2 for a second row of sub-pixels. FIG. 6D shows a representative voltage V3 for a third row of sub-pixels. FIG. 6E shows a representative voltage V4 for a fourth row of sub-pixels. FIG. 6F shows a representative voltage V5 for a fifth row of sub-pixels.

FIGS. 6H-6M show the six equally spaced clock signals MCLK, DCLK1, DCLK2, DCLK3, DCLK4, and DCLK5 that are used to individually drive the six LED strings 152. FIG. 6H shows the modulated control clock signal MCLK. FIG. 6I shows a delayed modulated control clock signal DCLK1 that is delayed 60° from the modulated control clock signal MCLK. FIG. 6J shows a delayed modulated control clock signal DCLK2 that is delayed 60° from the LED control signal DCLK1.

FIG. 6K shows a delayed modulated control clock signal DCLK3 that is delayed 60° from the delayed modulated control clock signal DCLK2. FIG. 6L shows a delayed modulated control clock signal DCLK4 that is delayed 60° from the delayed modulated control clock signal DCLK3. FIG. 6M shows a delayed modulated control clock signal DCLK5 that is delayed 60° from the delayed modulated control clock signal DCLK4.

FIG. 6N shows a composite total LED on time. In accordance with the present invention, as shown in FIG. 6N, by selecting the frequency of the modulated control clock signal MCLK and the number of LED strings 152 so that the product of the frequency of the modulated control clock signal MCLK multiplied by the number of LED strings 152 is equal to the line clock frequency LCLK, the line banding image artifact is substantially eliminated.

Thus, an LCD device that substantially eliminates the line banding artifact that results from the interaction of the LCD ripple and the LED flicker has been described. The LCD device utilizes an LED backlight controller that divides down an accurate high-frequency clock signal that is synchronized to the pixel clock signal to a frequency which, when multiplied by the number of LED strings, is equal to the line clock frequency.

It should be understood that the above descriptions are examples of the present invention, and that various alternatives of the invention described herein may be employed in practicing the invention. Thus, it is intended that the following claims define the scope of the invention and that structures and methods within the scope of these claims and their equivalents be covered thereby.

What is claimed is:

1. A light emitting diode (LED) backlight controller operable with a display having an LED backlight source including a predetermined number N of LED strings, and with display control circuitry that generates control signals for the display including a line clock signal with a line clock frequency, comprising:

a clock divider that receives from the display control circuitry a backlight clock signal with a backlight clock frequency, and divides down the backlight clock frequency to generate an intermediate clock signal with an intermediate clock frequency; and a pulse width modulator that generates a number of pulse width modulated clock (PWM) signals each with a duty cycle corresponding to an adjustable backlight level, the number of generated PWM signals corresponding to the number N of LED strings, and each of the N PWM signals having a frequency corresponding to the intermediate clock signal, and each of the N PWM signals successively delayed from a preceding PWM signal by a delay corresponding to a period of the line clock signal;

wherein a product of the intermediate clock frequency multiplied by the number of PWM signals (N) is equal to the line clock frequency.

2. The LED backlight controller of claim 1 wherein the pulse width modulator receives from the display control circuitry a duty cycle bias voltage corresponding to adjustable backlight level.

3. The LED backlight controller of claim 1 wherein the clock divider includes:

a first counter that divides down the backlight clock frequency to generate a local line clock signal with a local line clock frequency; and a second counter that divides down the local line clock frequency to generate the intermediate clock signal, the local line clock signal and the line clock signal being substantially identical and in phase.

4. The LED backlight controller of claim 1 wherein the backlight clock signal and the line clock signal are synchronized to a pixel clock signal generated by the display control circuitry.

5. A liquid crystal display (LCD) device including an LED backlight source with a predetermined number N of LED strings, comprising:

display control circuitry that generates control signals for the display including a line clock signal with a line clock frequency, and a duty cycle bias voltage corresponding to adjustable backlight level; and an LED backlight controller having:

a clock divider that receives from the display control circuitry a backlight clock signal with a backlight clock frequency, and divides down the backlight clock frequency to generate an intermediate clock signal with an intermediate clock frequency; and a pulse width modulator that generates a number of pulse width modulated clock (PWM) signals each with a duty cycle corresponding to the duty cycle bias voltage, the number of generated PWM signals corresponding to the number N of LED strings, and each of the N PWM signals having a frequency corresponding to the intermediate clock signal, and each of the N PWM signals successively delayed from a preceding PWM signal by a delay corresponding to a period of the line clock signal;

wherein a product of the intermediate clock frequency multiplied by the number of PWM signals (N) is equal to the line clock frequency.

6. The LCD device of claim 5 wherein the display control circuitry further generates a pixel clock signal and a frame clock signal.

7. The LCD device of claim 6 wherein the backlight clock signal is two orders of magnitude greater than the frame clock signal.

8. The LCD device of claim 6 wherein the backlight clock signal and the line clock signal are synchronized to the pixel clock signal.

9. A method of controlling LED (light emitting diode) backlight, employable with a display having an LED backlight source including a predetermined number N of LED strings, the display operable with a line clock signal with a line clock frequency, comprising:

generating a backlight clock signal with a backlight clock frequency;

dividing the backlight clock frequency to generate an intermediate clock signal with an intermediate clock frequency;

generating for each of the N LED strings a pulse width modulated clock (PWM) signals with a duty cycle corresponding to an adjustable backlight level, wherein each of the N PWM signals having a frequency corresponding to the intermediate clock signal, and each of the N PWM signals successively delayed from a preceding PWM signal by a delay corresponding to a period of the line clock signal;

and wherein a product of the intermediate clock frequency multiplied by the number of PWM signals (N) is equal to the line clock frequency.

10. The method of claim 9 wherein the duty cycle of the PWM signals corresponds to a duty cycle bias voltage.

11. The method of claim 9 wherein dividing the backlight clock frequency is accomplished by:

dividing the backlight clock frequency to generate a local line clock signal with a local line clock frequency; and dividing the local line clock frequency to generate the intermediate clock signal, the local line clock signal and the line clock signal being substantially identical and in phase.

12. The method of claim 9 wherein the backlight clock signal and the line clock signal are synchronized to a pixel clock signal associated with the display.

* * * * *